US010185264B2

(12) United States Patent
Yasui

(10) Patent No.: US 10,185,264 B2
(45) Date of Patent: Jan. 22, 2019

(54) IMAGE FORMING APPARATUS WITH TRANSFER AND FIXING SECTIONS AND CONTROL THEREOF

(71) Applicants: KABUSHIKI KAISHA TOSHIBA, Tokyo (JP); TOSHIBA TEC KABUSHIKI KAISHA, Tokyo (JP)

(72) Inventor: Kazumasa Yasui, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/717,657

(22) Filed: Sep. 27, 2017

(65) Prior Publication Data

US 2018/0307166 A1 Oct. 25, 2018

(30) Foreign Application Priority Data

Apr. 21, 2017 (JP) ..... 2017-084732

(51) Int. Cl.
*G03G 15/00* (2006.01)
*G03G 15/20* (2006.01)

(52) U.S. Cl.
CPC ..... *G03G 15/50* (2013.01); *G03G 15/5058* (2013.01)

(58) Field of Classification Search
CPC ..... G03G 15/50; G03G 15/5054; G03G 15/5058; G03G 15/2075; G03G 21/00; G03G 21/0041
See application file for complete search history.

(56) References Cited

U.S. PATENT DOCUMENTS 6,456,310 B1 * 9/2002 Wallace ..... G03G 15/0152 347/116
6,539,199 B1 3/2003 Miyata et al.
6,903,758 B1 * 6/2005 Kerxhalli ..... G03G 15/0152 347/116
2010/0272449 A1 * 10/2010 Yoshida ..... G03G 21/00 399/2
2017/0015128 A1 1/2017 Nishimura et al.

* cited by examiner

*Primary Examiner* — Sophia S Chen
(74) *Attorney, Agent, or Firm* — Foley & Lardner LLP

(57) ABSTRACT

An image forming apparatus includes an image forming section, a sensor and a control section. The image forming section forms a first image with at least two kinds of developing agents with different fixation properties. The sensor detects the first image formed on an image formed section by the image forming section. The control section amends deviation of the first image on the image formed section by the image forming section when a detection result of the sensor that the first image formed by the image forming section is not formed at a predetermined position of the image formed section.

10 Claims, 6 Drawing Sheets

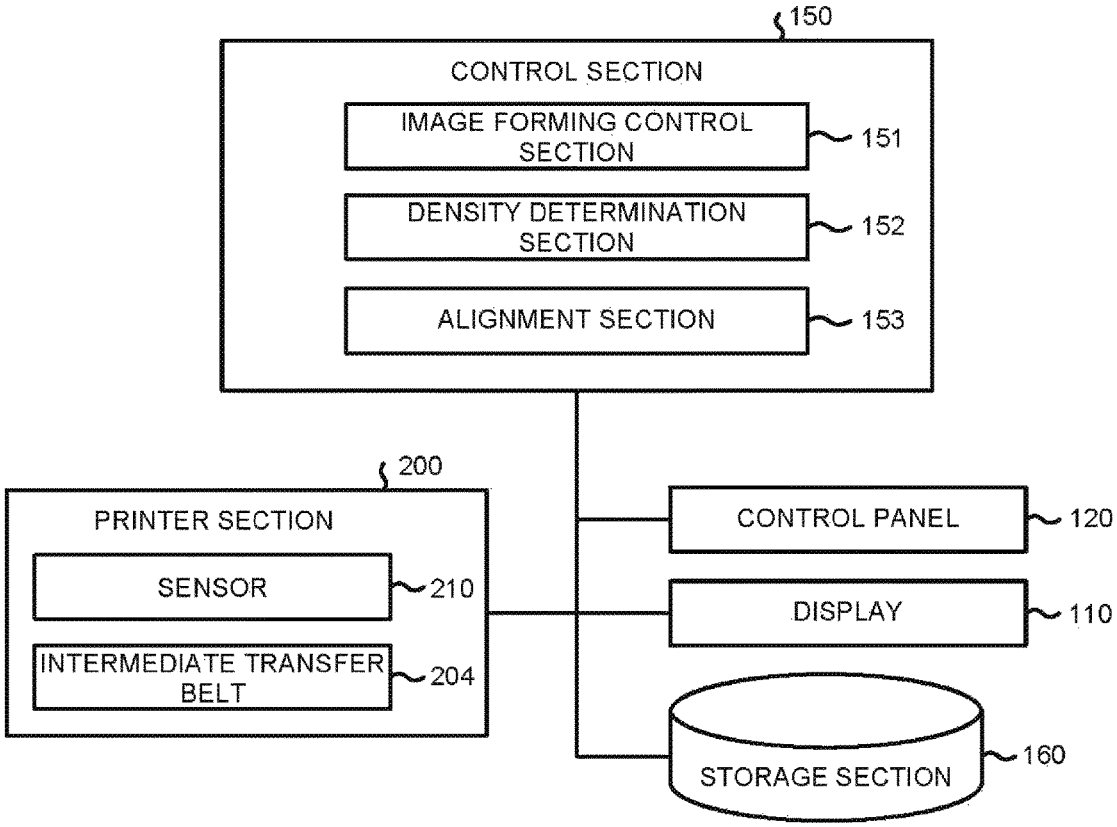
FIG.4
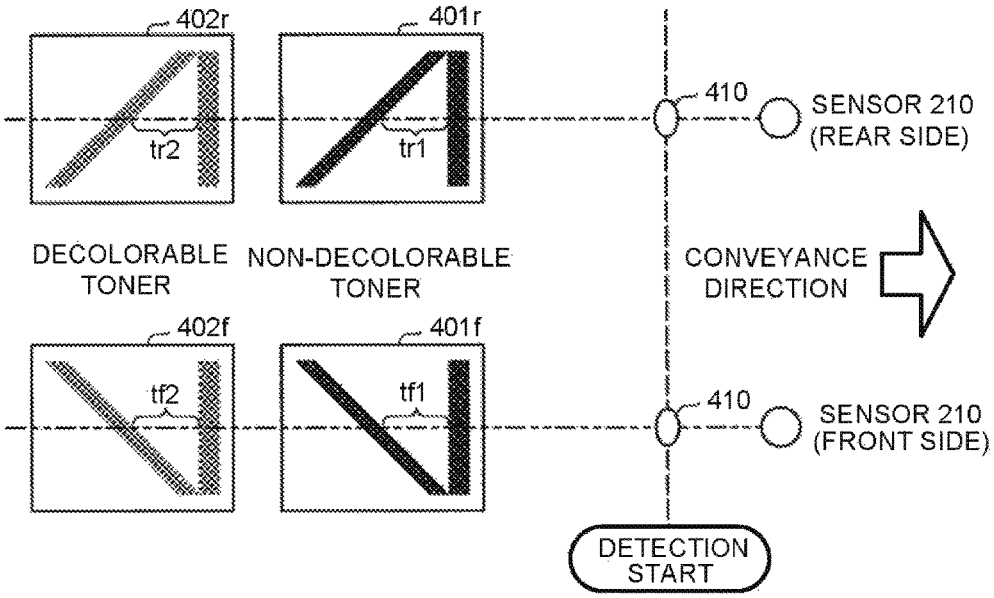

IMAGE FORMING APPARATUS WITH TRANSFER AND FIXING SECTIONS AND CONTROL THEREOF

CROSS-REFERENCE TO RELATED APPLICATION

This application is based upon and claims the benefit of priority from Japanese Patent Application No. 2017-084732, filed Apr. 21, 2017, the entire contents of which are incorporated herein by reference.

FIELD

Embodiments described herein relate generally to an image forming apparatus.

BACKGROUND

Conventionally, an image forming apparatus for carrying out printing with non-decolorable toner or decolorable toner carries out printing according to respective setting information of normal toner or decolorable toner. Thus, even for an alignment processing for matching print positions of toner printed on a sheet, printing is carried out for each toner and adjustment is carried out individually. Thus, there is a case in which confirmation and adjustment are carried out through printing of two times and time is spent without confirming print positions of the normal toner and the decolorable toner through printing of one time. The adjustment work of two times requires time, for example, in a confirmation work carried out by an assembling person at the time of assembly of products and a maintenance work carried out by a service person.

DESCRIPTION OF THE DRAWINGS

FIG. 3 is a functional block diagram illustrating a constitution of an alignment function of an image forming apparatus of one embodiment;

FIG. 4 is a diagram illustrating an example of density value acquisition by a sensor of one embodiment;

DETAILED DESCRIPTION

In one embodiment, an image forming apparatus comprises an image forming section, a sensor and a control section. The image forming section forms a first image with at least two kinds of developing agents with different fixation properties. The sensor detects the first image formed on an image formed section by the image forming section. The control section amends deviation of the first image on the image formed section by the image forming section when a detection result of the sensor that the first image formed by the image forming section is not formed at a predetermined position of the image formed section.

Hereinafter, an image forming apparatus of an embodiment is described with reference to the accompanying drawings.

Figure 1:
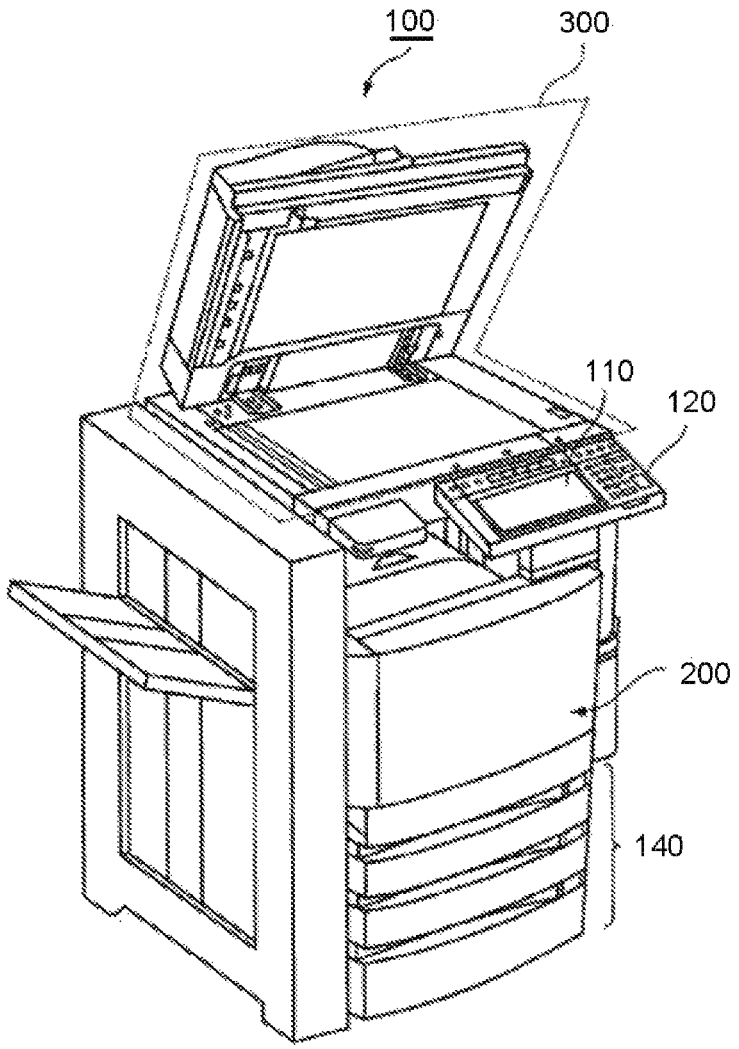
FIG. 1 is an external view illustrating an example of an entire constitution of an image forming apparatus of an embodiment.

FIG. 1 is an external view illustrating an example of an entire constitution of an image forming apparatus 100 of one embodiment. The image forming apparatus 100 is, for example, a multi-functional machine. The image forming apparatus 100 is provided with a display 110, a control panel 120, a sheet housing section 140, a manual feed unit 141 (see FIG. 2), a printer section 200 and an image reading section 300. Furthermore, the printer section 200 of the image forming apparatus 100 may be a device for fixing a toner image.

The image forming apparatus 100 forms an image on a sheet with a developing agent such as toner and the like. The toner includes a non-decolorable toner that cannot be decolored and a decolorable toner that can be decolored after image formation. The non-decolorable toner and the decolorable toner have different fixation properties to a sheet. The fixation property refers to, for example, a range of a fixing temperature to a sheet. For example, the image forming apparatus 100 fixes the decolorable toner on a sheet at a temperature in a range from 95° C. to 113° C. The non-decolorable toner may be fixed at a temperature in a range from 90° C. to 160° C. or from 100° C. to 165° C. The range of the fixing temperature of the non-decolorable toner may be different depending on performances of the image forming apparatus 100. For example, for a low-speed machine, the range of the fixing temperature is set to be low, and for a high-speed machine, the range of the fixing temperature is set to be high. Further, the decolorable toner is decolored by being heated. The decolorable toner is decolored if heated in a range from 115° C. to 160° C. The sheet is, for example, a paper. The sheet may be any object as long as the image forming apparatus 100 can form an image on the surface thereof.

The display 110 is an image display device such as a liquid crystal display, an organic EL (Electro Luminescence) display and the like. The display 110 displays various kinds of information relating to the image forming apparatus 100.

The control panel 120 includes a plurality of buttons. The control panel 120 receives an operation from a user or a service technician. The control panel 120 outputs a signal corresponding to an operation carried out by the user or the service technician to a control section of the image forming apparatus 100. Furthermore, the display 110 and the control panel 120 can be separate or both may be integrated into a single touch panel. Furthermore, in one embodiment, the user or the service technician enables the image forming apparatus 100 to execute an alignment processing by operating a predetermined button of the control panel 120.

The sheet housing section 140 houses sheets to be used for image formation by the printer section 200. The sheets to be used for image formation by the printer section 200 are arranged in the manual feed unit 141 by the user or the service technician.

The printer section 200 forms an image on a sheet on the basis of image information generated by the image reading section 300 or image information received via a communication path. The printer section 200 forms the image with, for example, the following processing. The image forming section of the printer section 200 forms an electrostatic latent image on a photoconductive drum on the basis of the image information. The image forming section of the printer section 200 enables a developing agent to adhere to the electrostatic latent image to form a visible image. One example of a developing agent is toner. Furthermore, the sheet on which the image is formed may be a sheet housed in the sheet housing section 140 or a sheet manually fed via the manual feed unit 141. In one embodiment, the printer section 200 carries out the image formation with non-decolorable toner and decolorable toner.

The image reading section 300 reads the image information of a read object as intensity of light. The image reading section 300 records the read image information. The recorded image information may be sent to another information processing apparatus via a network. The recorded image information may be used for the image formation on the sheet through the printer section 200.

Figure 2:
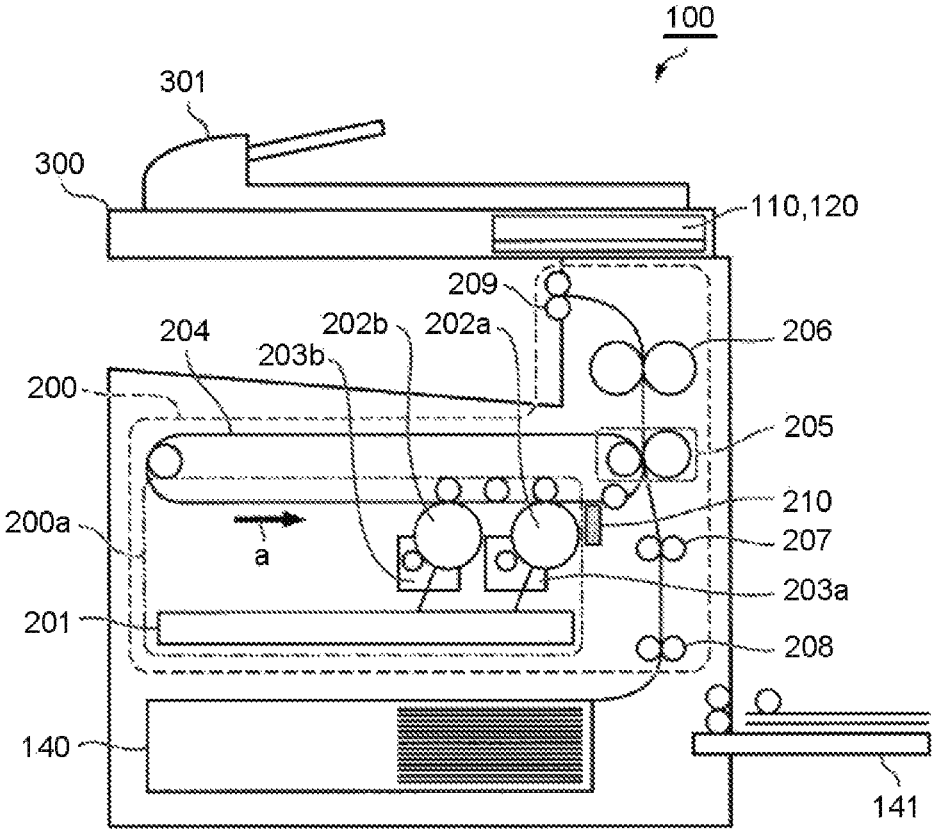
FIG. 2 is a cross-sectional view illustrating an example of an entire constitution of an image forming apparatus of one embodiment.

FIG. 2 is a cross-sectional view illustrating an example of an entire constitution of the image forming apparatus 100 of one embodiment. The image forming apparatus 100 is provided with the display 110, the control panel 120, the sheet housing section 140, the manual feed unit 141, the printer section 200, the image reading section 300, and a RADF (Reversing Auto Document Feeder) 301. The printer section 200 is provided with an image forming section 200*a*, an intermediate transfer belt 204, a transfer roller 205, a fixing section 206, a resist roller 207, a conveyance roller 208, a sheet discharge roller 209 and sensors 210. The image forming section 200*a* is provided with a laser unit 201, a first photoconductive drum 202*a*, a second photoconductive drum 202*b*, a first developing device 203*a* and a second developing device 203*b*. Hereinafter, descriptions of functions described in FIG. 1 are omitted.

The printer section 200 is arranged between the sheet housing section 140 and the image reading section 300. The printer section 200 carries out an image forming processing. In the image forming processing, the image forming section 200*a* forms an image on the intermediate transfer belt 204. Specifically, the laser unit 201 forms an electrostatic latent image by carrying out exposure on the first photoconductive drum 202*a* or the second photoconductive drum 202*b* depending on image data. The first photoconductive drum 202*a* and the first developing device 203*a* form, on the basis of the electrostatic latent image, a visible image on the intermediate transfer belt 204 with the non-decolorable toner. The second photoconductive drum 202*b* and the second developing device 203*b* form, on the basis of the electrostatic latent image, a visible image on the intermediate transfer belt 204 with the decolorable toner. The intermediate transfer belt 204 moves along an arrow direction a. The transfer roller 205 transfers the formed visible image on a sheet fed from the sheet housing section 140. The fixing section 206 of the printer section 200 fixes the visible image on the sheet by heating and pressuring the sheet. Pressuring is carried out by a pressure roller included in the fixing section 206. The intermediate transfer belt 204 is one embodiment of an image formed section. The pressure roller is one embodiment of a second rotating body.

The sensors 210 acquire density values on the intermediate transfer belt 204 when carrying out the alignment processing. When the visible images are formed on the intermediate transfer belt 204, the sensors 210 acquire different density values. The sensors 210 output the acquired density values to a density determination section 152. The alignment processing refers to a processing for adjusting a plurality of print positions of toner. The alignment processing refers to a processing for matching print positions of the non-decolorable toner and the decolorable toner on the sheet. In one embodiment, the sensors 210 are arranged at two locations of front and rear sides of the intermediate transfer belt 204. The sensors 210 may be arranged at three or more locations. The sensors 210 may acquire the density values at a predetermined timing, or may usually acquire the density values. The predetermined timing may refer to, for example, every 1second or every 2 seconds. The density value is one embodiment of color information.

FIG. 4 is a diagram illustrating an example of density value acquisition by sensor 210 of one embodiment. The sensors 210 acquire density values on areas 410, and output the acquired density values to the density determination section 152. Characters of "<" included in an area 401*r* and an area 401*f* are pattern images formed with the non-decolorable toner. Characters of "<" included in an area 402*r* and an area 402*f* are pattern images formed with the decolorable toner. The pattern images move in a conveyance direction together with movement of the intermediate transfer belt 204. When pattern images are not overlapped with the areas 410, the sensors 210 acquire density values of the intermediate transfer belt 204, and output the acquired density values to the density determination section 152. When pattern images are overlapped with the areas 410, the sensors 210 acquire the density values of the non-decolorable toner or the decolorable toner, and output the acquired density values to the density determination section 152.

The sheet fed from the sheet housing section 140 or the manual feed unit 141 is fed to the printer section 200 by the resist roller 207 and the conveyance roller 208. The fed sheet is discharged from the image forming apparatus 100 by the sheet discharge roller 209 after the image formation.

It is possible that the RADF 301 continuously reads a plurality of documents arranged in the image reading section 300.

FIG. 3 is a functional block diagram illustrating a constitution of an alignment function of the image forming apparatus 100 of one embodiment. The image forming apparatus 100 is provided with the display 110, the control panel 120, a control section 150, a storage section 160 and the printer section 200. Furthermore, descriptions of functional sections described in FIG. 1 are omitted.

The control section 150 controls operations of respective sections of the image forming apparatus 100. The control section 150 is executed by a device including, for example, a CPU (Central Processing Unit) and a RAM (Random Access Memory). The control section 150 functions as an image forming control section 151, a density determination section 152 and an alignment section 153 by executing an alignment program.

The image forming control section 151 carries out an image forming processing by controlling the printer section 200. The image forming control section 151 enables the printer section to carry out the image formation in response to a received instruction. The received instruction is, for example, the alignment processing. The received instruction may be a print, a copy or a fax received from the user or the service technician.

The density determination section 152 determines whether or not the density values received from the sensors 210 are predetermined densities. When received density values are the predetermined densities, the density determination section 152 reflects the density values in a control condition of an image density. The density determination section 152 carries out control for carrying out a density adjustment and control of image confirmation when received density values are not the predetermined densities. The predetermined densities are, for example, pre-stored densities. The density determination section 152 carries out an adjustment of densities printed by the image forming section 200*a* in the control for carrying out the density adjustment.

The control of image confirmation is described with reference to FIG. 4. The density determination section 152 calculates distances tr1 and tr2 on the basis of output of the sensor 210 at the rear side. Further, the density determination section 152 calculates distances tf1 and tf2 on the basis of output of the sensor 210 at the front side. When tr1, tr2, tf1 and tf2 meet predetermined conditions, alignment control is not executed. On the contrary, when the predetermined conditions are not met, the alignment control is executed. The predetermined conditions are cases in which, for example, tr1 and tr2 are equal, tf1 and tf2 are equal, and tr1 and tr2 are different. The density determination section 152 outputs alignment control information (for example, a ratio of each distance) for correcting tr1, tr2, tf1 and tf2 to equal values to the alignment section 153. The density determination section 152 is one embodiment of a color information determination section.

The alignment section 153 carries out the alignment control on the basis of the alignment control information received from the density determination section 152. Specifically, the alignment section 153 corrects setting of the image forming section 200*a* such that tr1, tr2, tf1 and tf2 become equal values. Furthermore, the alignment control is executed at the time of manufacture, at the time of unpacking and at the time the service technician carries out the image adjustment.

The alignment processing is executed in a predetermined mode of the image forming apparatus 100. The predetermined mode refers to, for example, an adjustment mode carried out when the service technician carries out maintenance of the image forming apparatus 100, or a test mode for carrying out operation confirmation for carrying out assembly. The adjustment mode and the test mode can be entered by carrying out a special operation (for example, login to an ID for management) via the control panel 120 and the like.

In the alignment processing, the image forming control section 151 forms pattern images on the intermediate transfer belt 204 with the decolorable toner and the non-decolorable toner by the printer section 200. The pattern images may be, for example, characters of "<" or a plurality of vertical bars. The pattern images may be any shape as long as the sensor 210 can detect density values of the toner and the intermediate transfer belt 204.

In the alignment processing, if the pattern images are formed, the sensors 210 acquire the density value on the intermediate transfer belt 204. The sensors 210 output the acquired density values to the density determination section 152. The density determination section 152 determines whether or not the received density values are the predetermined density values. The density determination section 152 outputs a determination result to the alignment section 153. The toner is removed from on the intermediate transfer belt 204 by a cleaning member such as a cleaning blade (not shown). That is, the image forming control section 151 does not form the pattern images on the sheet. The pattern image is one embodiment of a first image.

The alignment section 153 carries out the alignment depending on the determination result. After the alignment, the image forming control section 151 enables the printer section 200 to form a printing confirmation image. The printing confirmation image is used for the user or the service technician to visually determine presence/absence of printing deviation between the decolorable toner and the non-decolorable toner in the image forming apparatus 100. The user or the service technician carries out the alignment processing again if it is determined that there is the printing deviation as a result of visual determination. No processing is carried out if there is no printing deviation. The printing confirmation image is one embodiment of a second image. It is possible to carry out tests of the decolorable toner and the non-decolorable toner once at the time of assembly by carrying out the alignment processing in this way.

The storage section 160 is constituted by a storage device such as a magnetic hard disk device, a semiconductor storage device or a ROM (Read Only Memory). The storage section 160 stores a fixing temperature of each toner. The image forming control section 151 controls a temperature of the fixing section 206 on the basis of the fixing temperature stored in the storage section.

Figure 5:
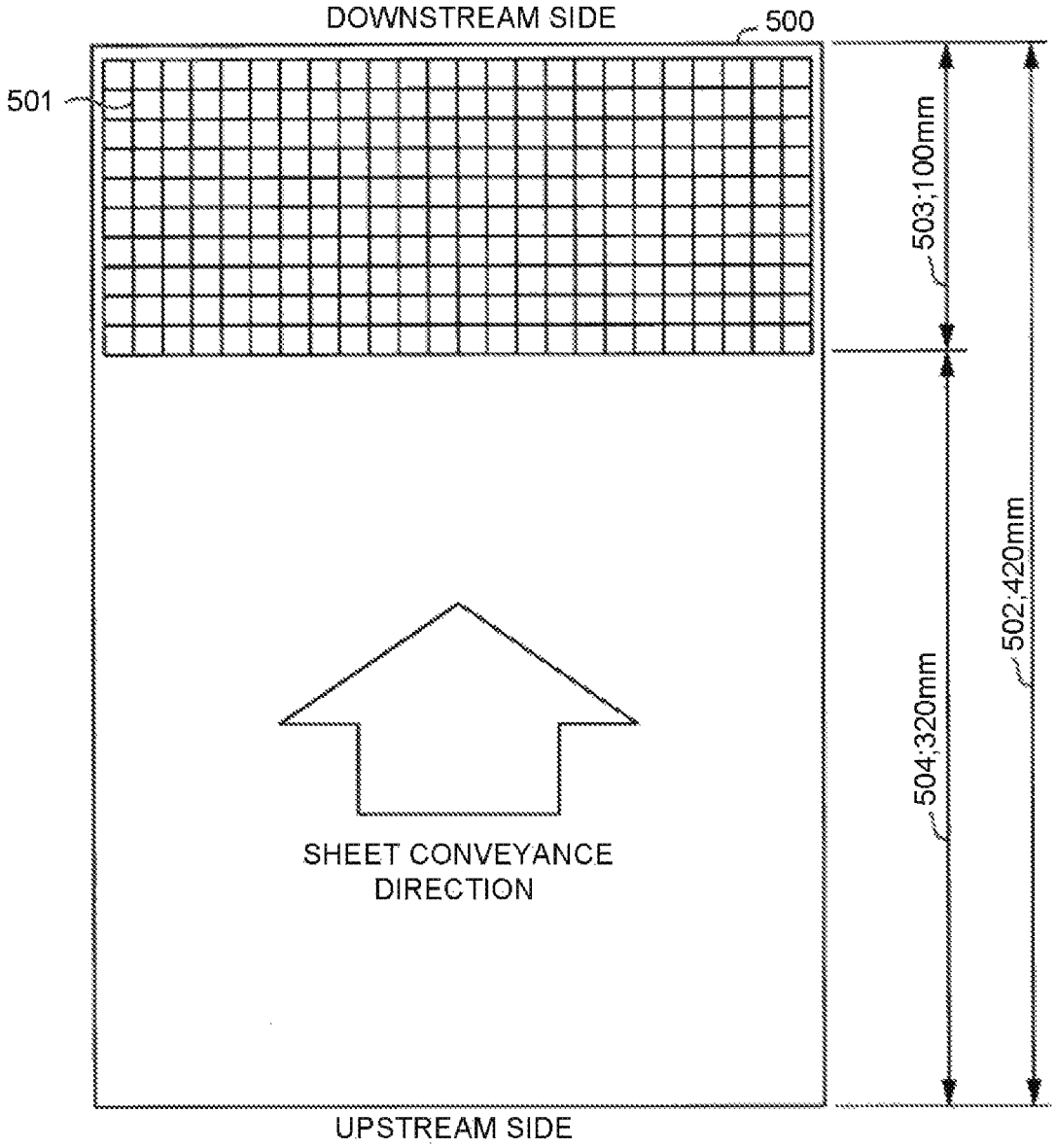
FIG. 5 is a diagram illustrating an example of a printing confirmation image of one embodiment.

FIG. 5 is a diagram illustrating an example of a printing confirmation image of one embodiment. An area 500 is a sheet. An area 501 is a printing confirmation image formed on the sheet. An area 502 is a length of the sheet in a sheet conveyance direction. The length of the sheet is 420 mm. An area 503 is a length of the printing confirmation image in the sheet conveyance direction. The length of the printing confirmation image is 100 mm. An area 504 is a length of a margin of the sheet from an upstream side to a downstream side in the sheet conveyance direction. The length of the margin of the sheet is 320 mm. The "upstream side" and the "downstream side" in the present description refer to the upstream side and the downstream side in the conveyance direction, respectively.

In the printing confirmation image, images are formed in a lattice shape. The lattice-shaped images are formed in such a manner that both of the non-decolorable toner and the decolorable toner are fixed at the same position. When there is deviation in the setting of the printer section 200, the non-decolorable toner and the decolorable toner are fixed at different positions. In this way, the user or the service technician may carry out the alignment processing.

The margin of the sheet is used for transferring toner fixed on a fixing roller onto the sheet. In the printing confirmation image, the decolorable toner and the non-decolorable toner are overlapped to be printed. In this way, a target temperature of the fixing section is set to toner of which the fixing temperature is low. In the present example, if the target temperature matches the fixing temperature of the decolorable toner, the non-decolorable toner is decolored and the service technician cannot confirm squares of lattices. Thus, the printing is carried out in accordance with the fixing temperature of the non-decolorable toner. In this way, since the non-decolorable toner does not reach the fixing temperature, the non-decolorable toner is not fixed sufficiently to the sheet, toner more than usual adheres to the fixing roller, and there is a possibility that the fixing roller is stained. Thus, after printing the printing confirmation image, the toner adhering to the fixing roller is transferred to the sheet by contacting the margin of the sheet with the fixing roller. With such a constitution, the fixing roller is cleaned by the margin of the sheet. Particularly, the image forming apparatus 100 is transported by a sea route after assembly. Since the image forming apparatus 100 is not used during transport, it is possible that toner is solidified and quality deterioration occurs during transport. Thus, the quality deterioration can be prevented by cleaning the fixing roller. Furthermore, in one embodiment, the length of the margin of the sheet is longer than that of the circumference of the fixing roller. If the length of the margin of the sheet is longer than that of the circumference of the fixing roller, entire sides of the fixing roller can be cleaned. The fixing roller is one embodiment of a first rotating body.

Figure 6:
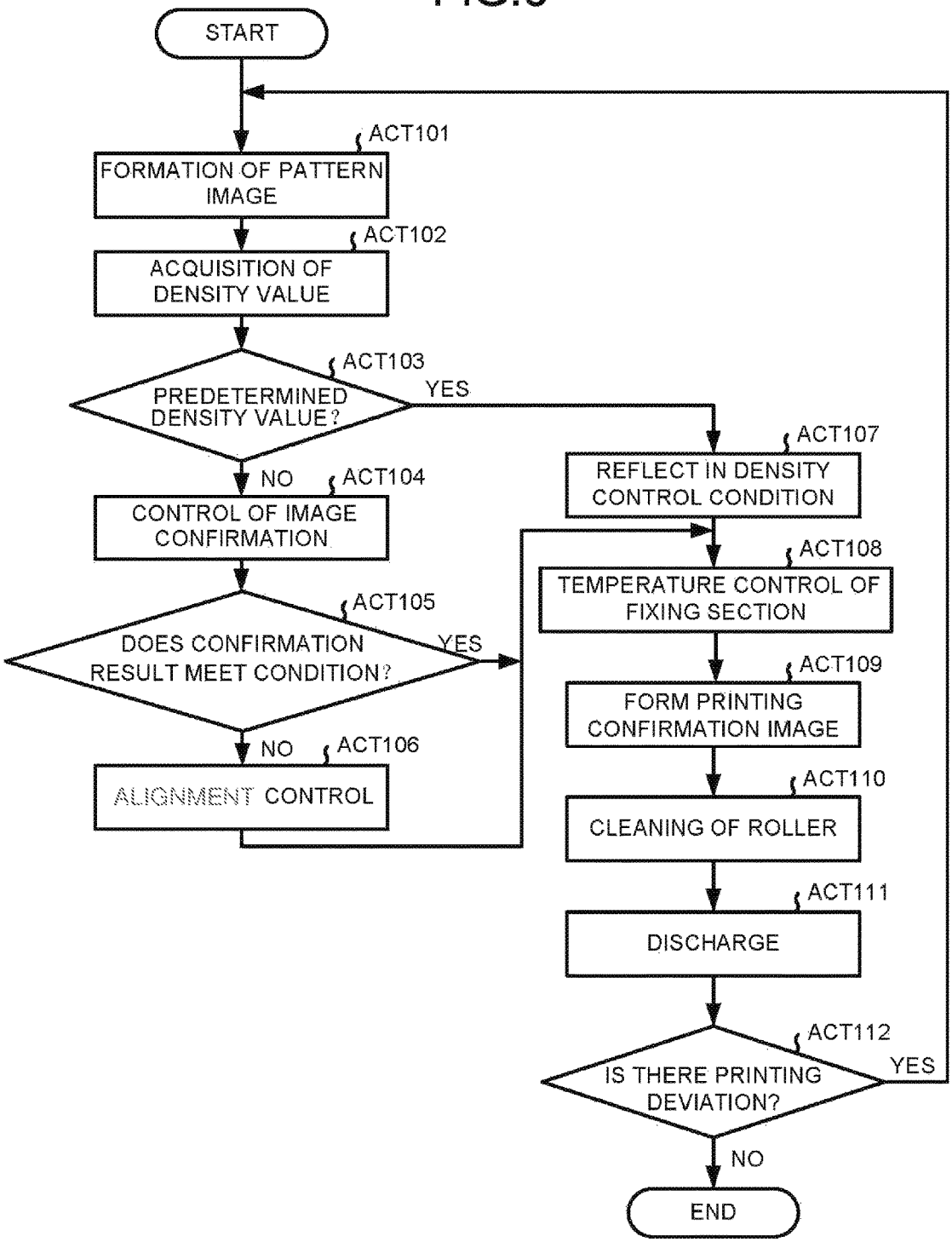
FIG. 6 is a flowchart illustrating the flow of an alignment processing of one embodiment.

FIG. 6 is a flowchart illustrating the flow of the alignment processing of one embodiment. If receiving an instruction of the alignment processing from the user or the service technician via the control panel 120, the image forming control section 151 of the image forming apparatus 100 forms a pattern image on the intermediate transfer belt 204 (ACT 101). The sensor 210 of the printer section 200 acquires a density value on the intermediate transfer belt 204 (ACT 102). The sensor 210 outputs the acquired density value to the density determination section 152. The density determination section 152 determines whether or not the acquired density value is a predetermined density (ACT 103).

If the acquired density value is not the predetermined density (No in ACT 103), the density determination section 152 carries out the control for carrying out the density adjustment and the control of image confirmation (ACT 104). The density determination section 152 determines whether or not the result of the control of image confirmation meets a predetermined condition (ACT 105). If the result meets the predetermined condition (YES in ACT 105), the flow transits to a processing in ACT 108. If the predetermined condition is not met (No in ACT 105), the alignment section 153 carries out the alignment control (ACT 106). Specifically, the alignment section 153 corrects the setting of the image forming section 200*a* such that tr1, tr2, tf1 and tf2 become equal values.

If the alignment is not required (Yes in ACT 103), the density determination section 152 reflects the density value in the control condition of the image density (ACT 107). The image forming control section 151 increases the temperature of the fixing section 206 to the fixing temperature of the non-decolorable toner (ACT 108). The image forming control section 151 forms a printing confirmation image on a sheet (ACT 109). The image forming control section 151 cleans the fixing roller by conveying the sheet and contacting the margin of the sheet with the fixing roller (ACT 110). The sheet on which the printing confirmation image is formed is discharged from the image forming apparatus 100 (ACT 111).

The user or the service technician views the discharged sheet and determines wherever or not there is the printing deviation (ACT 112). If there is the printing deviation (YES in ACT 112), the flow transits to the processing in ACT 101, and the user or the service technician instructs the alignment processing again. If there is no printing deviation (No in ACT 112), the processing is ended.

In the image forming apparatus 100 constituted in this way, the sensor 210 acquires the density value on the intermediate transfer belt 204. If the acquired density value is the predetermined density, the density determination section 152 reflects the density value in the control condition of the image density. The density determination section 152 carries out the control for carrying out the density adjustment and the control of image confirmation if the density value is not the predetermined density. On the basis of the control result of the image confirmation, the alignment section 153 can carryout alignment of the non-decolorable toner and the decolorable toner once by carrying out the alignment of the image forming section 200*a*. Thus, the alignment carried out on the non-decolorable toner and the decolorable toner twice is carried out once so far, operation confirmation at the time of manufacture of the image forming apparatus 100 and maintenance after shipment can be carried out in a shorter time.

Furthermore, the alignment processing in FIG. 6 is implemented when the user or the service technician operates the control panel 120; however, the present disclosure is not limited to this. For example, the alignment processing may be executed at a predetermined timing at which a predetermined number of sheets is printed or at a designated time.

Figure 7:
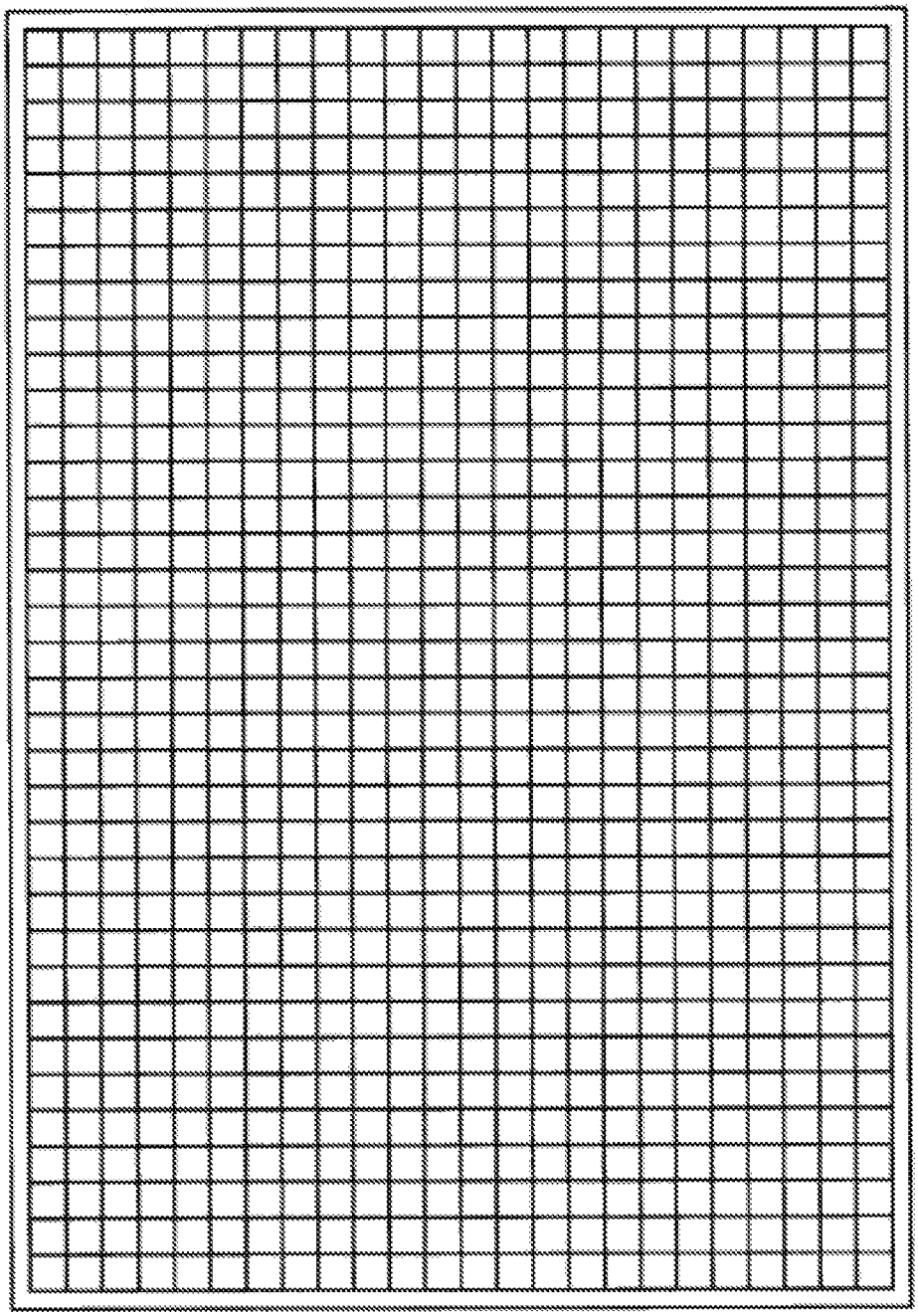
FIG. 7 is a diagram illustrating an example of a conventional printing confirmation image.

Further, FIG. 7 is a diagram illustrating one concrete example of the conventional printing confirmation image. In FIG. 7, since there is no margin, the toner left on the fixing roller cannot be peeled off. Thus, the printer section 200 transfers the toner adhering to the fixing roller onto the sheet by arranging a margin longer than the length of the circumference of the fixing roller from the upstream side to the downstream side of the conveyance direction to form the printing confirmation image. With such a constitution, the toner left on the fixing roller can be peeled off. Thus, it is possible to prevent degradation of image formation caused by the adhesion of the toner left on the fixing roller to the sheet at the time of the image formation.

When forming the image with the decolorable toner, the printer section 200 may make the margin wider than a case of forming the image with the non-decolorable toner. In the image forming apparatus constituted in this way, even if the image formation is carried out on the sheet after decoloring of the toner, occurrence of peeling jam can be suppressed.

In at least one embodiment described herein, the control section 150 is set to a software function section; however, it may be a hardware function section such as a LSI.

In at least one embodiment described herein, the non-decolorable toner and the decolorable toner can be aligned in one process by including the density determination section 152, the alignment section 153 and the sensor 210.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form a first image on an image formed section with at least two developing agents having different fixation properties;

a sensor configured to detect the first image;

a control section configured to amend deviation of the first image when a detection result of the sensor indicates that the first image is not formed at a predetermined position of the image formed section;

a transfer section configured to transfer the first image formed on the image formed section onto a sheet; and a fixing section arranged at a downstream side of a sheet conveyance direction with respect to the transfer section, and comprising:

a first rotating body, a second rotating body, and a heat generation section for enabling the first rotating body to generate heat, wherein the control section controls the image forming section, and wherein the image forming section forms a second image by leaving a margin with a length of a circumference of the first rotating body on the sheet in a predetermined mode.

2. The image forming apparatus according to claim 1, wherein the image forming section forms the second image by overlapping and fixing the at least two developing agents on a sheet.

3. The image forming apparatus according to claim 1, wherein the control section controls the fixing section at a fixing temperature, the fixing temperature being a lowest fixing temperature of the at least two developing agents when the image forming section forms an image on the sheet by overlapping the at least two developing agents with different fixation properties in the predetermined mode.

4. The image forming apparatus according to claim 1, wherein the at least two developing agents comprise at least one decolorable developing agent.

5. The image forming apparatus according to claim 1, wherein the predetermined mode is an adjustment mode or a test mode.

6. A method for printing, comprising:

forming a first image on an image formed section with at least two developing agents having different fixation properties;

detecting the first image;

amending deviation of the first image when the detecting indicates that the first image is not formed at a predetermined position of the image formed section;

transferring the first image formed on the image formed section onto a sheet; and forming a second image by leaving a margin with a length of a circumference of a first rotating body on the sheet in a predetermined mode, wherein the first rotating body generates heat.

7. The method according to claim 6, wherein the second image is formed by overlapping and fixing the at least two developing agents on the sheet.

8. The method according to claim 6, further comprising controlling a fixing temperature of an image forming apparatus, the fixing temperature being a lowest fixing temperature of the at least two developing agents when overlapping the at least two developing agents with different fixation properties in the predetermined mode.

9. The method according to claim 6, wherein the at least two developing agents comprise at least one decolorable developing agent.

10. The method according to claim 6, wherein the predetermined mode is an adjustment mode or a test mode.

* * * * *